United States Patent [19]

Chang

[11] Patent Number: 4,793,868

[45] Date of Patent: Dec. 27, 1988

[54] THERMOMECHANICAL METHOD OF FORMING FATIGUE CRACK RESISTANT NICKEL BASE SUPERALLOYS AND PRODUCT FORMED

[75] Inventor: Keh-Minn Chang, Schenectady, N.Y.

[73] Assignee: General Electric Company, Schenectady, N.Y.

[21] Appl. No.: 907,275

[22] Filed: Sep. 15, 1986

[51] Int. Cl.[4] ..... C22F 1/10

[52] U.S. Cl. ..... 148/11.5 N; 148/12.7 N

[58] Field of Search ..... 148/12.7 N, 11.5 N, 148/2

[56] References Cited

PUBLICATIONS

Improving Crack Growth Resistance of IN718 Alloy Through Thermomechanical Processing, by K.-M. Chang, Metallurgy Laboratory, Corporate Research and Development, General Electric Company, Schenectady, New York, Report No. 85CRD187, Oct. 1985.

*Primary Examiner*—R. Dean

*Attorney, Agent, or Firm*—Paul E. Rochford; James C. Davis, Jr.; Paul R. Webb, II

[57] ABSTRACT

A method has been discovered for reducing fatigue crack growth in nickel base superalloys. The method involves the step of forming a part to near net shape by forging or by other forming technique. The part is then heat treated to develop regular grains by recystallization. Grains of about 35 μm average diameters are prepared. The part is then deformed at least 15% to achieve a net shape desired.

7 Claims, 6 Drawing Sheets

THERMOMECHANICAL METHOD OF FORMING FATIGUE CRACK RESISTANT NICKEL BASE SUPERALLOYS AND PRODUCT FORMED

RELATED APPLICATIONS

The subject application relates generally to the subject matter of application Ser. No. 677,449, filed Dec. 3, 1984 which application is assigned to the same assignee as the subject application herein.

The subject matter of the subject application relates generally to that of three commonly assigned simultaneously filed applications, the subject matter of which is incorporated herein by reference, as follows: Ser. Nos. 907,271; 907,550; and 907,276, each of which was filed on Sept. 15, 1986.

The texts of all the related applications is incorporated herein by reference.

BACKGROUND OF THE INVENTION

It is well known that nickel based superalloys are extensively employed in high performance environments. Such alloys have been used extensively in jet engines and in gas turbines where they must retain high strength and other desirable physical properties at elevated temperatures of a 1000F. or more.

The strength of these alloys is related to the presence of a strengthening precipitate, which in many cases is a $\gamma'$ precipitate or $\gamma''$ precipitate. More detailed characteristics of the phase chemistry of precipitates are given in "Phase Chemistries in Precipitation-Strengthening Superalloy" by E. L. Hall, Y. M. Kouh, and K. M. Chang [Proceedings of 41st. Annual Meeting of Electron Microscopy Society of America, August 1983 (p. 248)].

The following U.S. patents disclose various nickel-base alloy compositions, some of which contain such precipitates: U.S. Pat. Nos. 2,570,193; 2,621,122; 3,046,108; 3,061,426; 3,151,881; 3,166,412; 3,322,534; 3,343,950; 3,575,734; 3,576,681; 4,207,098 and 4,336,312. The aforementioned patents are representative of the many alloying situations reported to date in which many of the same elements are combined to achieve distinctly different functional relationships between the elements such that phases from providing the alloy system with different physical and mechanical characteristics are formed. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

It is known that some of the most demanding sets of properties for superalloys are those which are needed in connection with jet engine construction. Of the sets of properties which are needed those which are needed for the moving parts of the engine are usually greater than those needed for static parts although the sets of needed properties are different for the different components of an engine.

Because some sets of properties have not been attainable in cast alloy materials, resort is sometimes had to the preparation of parts by powder metallurgy techniques. However, one of the limitations which attends the use of powder metallurgy techniques in preparing moving parts for jet engines is that of the purity of the powder. If the powder contains impurities such as a speck of ceramic or oxide the place where that speck occurs in the moving part becomes a latent weak spot where a crack may initiate or a latent crack.

To avoid problems with impure powder and similar problems it is sometimes preferred to form moving parts of jet engines such as disks with alloys which can be cast and wrought.

A problem which has been recognized to a greater and greater degree with many such nickel based superalloys is that they are subject to formation of cracks or incipient cracks, either in fabrication or in use, and that the cracks can actually initiate or propagate or grow while under stress as during use of the alloys in such structures as gas turbines and jet engines. The propagation or enlargement of cracks can lead to part fracture or other failure. The consequence of the failure of the moving mechanical part due to crack formation and propagation is well understood. In jet engines it can be particularly hazardous.

However, what has been poorly understood until recent studies were conducted was that the formation and the propagation of cracks in structures formed of superalloys is not a monolithic phenomena in which all cracks are formed and propagated by the same mechanism and at the same rate and according to the same parameters and criteria. By contrast the complexity of the crack generation and propagation and of the crack phenomena generally, and the interdependence of such propagation with the manner in which stress is applied, is a subject on which important new information has been gathered in recent years. The period during which stress is applied to a member to develop or propagate a crack, the intensity of the stress applied, the rate of application and of removal of stress to and from the member and the schedule of the application was not well understood in the industry until a study was conducted under contract to the National Aeronautics and Space Administration. This study is reported to a technical report identified as NASA CR-165123 issued from the National Aeronautics and Space Administration in August 1980, identified as "Evaluation of the Cyclic Behavior of Aircraft Turbine Disk Alloys", Part II, Final Report, by B. A. Cowles, J. R. Warren and F. K. Hauke, and prepared for the National Aeronautics and Space Administration, NASA Lewis Research Center, Contract NAS3-21379.

A principal unique finding of the NASA sponsored study was that the rate of propagation based on fatigue phenomena or in other words the rate of fatigue crack propagation (FCP) was not uniform for all stresses applied nor to all manners of applications of stress. More importantly, the finding was that fatigue crack propagation actually varied with the frequency of the application of stress to the member where the stress was applied in a manner to enlarge the crack. More surprising still, was the finding from the NASA sponsored study that the application of stress of lower frequencies rather than at the higher frequencies previously employed in studies actually increased the rate of crack propagation. In other words the NASA study revealed that there was a time dependence in fatigue crack propagation. Further the time dependence of fatigue crack propagation was found to depend not on frequency alone but on the time during which the member was held under stress or a so-called hold-time.

Following the discovery of this unusual and unexpected phenomena of increased fatigue crack propagation at lower stress frequencies there was some belief in the industry that this newly discovered phenomena represented an ultimate limitation on the ability of the nickel based superalloys to be employed in the stress bearing parts of the turbines and aircraft engines and that all design effort had to be made to design around this problem.

However, it has been discovered that it is feasible to construct parts of nickel based superalloys for use at high stress in turbines and aircraft engines with greatly reduced crack propagation rates.

The development of the superalloy compositions and methods of their processing of this invention focuses on the fatigue property and addresses in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys. According to this hold time pattern, the stress is held for a designated hold time each time the stress reaches a maximum in following the normal sine curve. This hold time pattern of application of stress is a separate criteria for studying crack growth. This type of hold time pattern was used in the NASA study referred to above.

The design objective is to make the value of da/dN as small and as free of time-dependency as possible.

It is pointed out in copending application Ser. No. 907,550, filed Sept. 15, 1986 that time dependent fatigue crack propagation can be reduced significantly by a thermal treatment of $\gamma'$ strengthened nickel base superalloys which have more than 35 volume percent of strengthening precipitate. As is pointed out in this copending application, the method involves a high temperature solutioning (supersolvus) solutioning of the $\gamma'$ precipitate followed by a controlled cobling at less than 250° F. per minute.

However, it has been found that the method of copending application Ser. No. 907,550 does not yield the beneficial results taught in that application when the method is applied to alloys with low precipitate content. For example, the method does not produce the fatigue crack propagation reduction when applied to Waspalloy or to IN 718 alloy. Waspalloy is $\gamma'$ hardened and has less than 35 volume percent and preferably about 30 volume percent $\gamma'$ precipitate. IN 718 is mainly $\gamma''$ hardened and has less than 35 volume percent and preferably about 20 percent by volume of $\gamma'$ precipitate.

I have done extensive studies on alloys of such lower $\Gamma'$ or $\gamma''$ precipitate content and have heat treated these alloys according to a variety of schedules which restrict fatigue crack propagation properties of alloys having higher precipitate content but without significant beneficial effect. I have found that none of these heat treatments develop different or advantageous microstructures or result in any significant reduction in fatigue crack propagation.

Pursuant to the present invention a method for processing a superalloy containing a lower concentration of strengthening precipitate is provided to produce materials with a superior set or combination of properties for use in advanced engine disk applications. The properties which are conventionally needed for materials used in disk applications include high tensile strength and high stress rupture strength. In addition the alloy prepared by the methods of the subject invention exhibits a desirable property of resisting crack growth propagation. Such ability to resist crack growth is essential for the component low cycle fatigue life or LCF.

In addition to this superior set of properties as outlined above, the alloy processed by the method of the present invention displays good forgeability and such forgeability permits greater flexibility in the use of various manufacturing processes needed in formation of parts such as disks for jet engines.

Superalloys with lower ranges of precipitate content generally have good forgeability and can be subjected to thermomechanical processing. The difference of certain thermomechanical processings on mechanical properties, like strength and rupture life, are known to a degree. However, nothing was known heretofore of the influence, if any, of thermomechanical processings on time-dependent fatigue crack propagation or the rates of such propagation.

As alloy products for use in turbines and jet engines have developed it has become apparent that different sets of properties are needed for parts which are employed in different parts of the engine or turbine. For jet engines the material requirements of more advanced aircraft engines continue to become more strict as the performance requirements of the aircraft engines are increased. The different requirements are evidenced, for example, by the fact that many blade alloys display very good high temperature properties in the cast form. However, the direct conversion of cast blade alloys into disk alloys is very unlikely because blade alloys display inadequate strength at intermediate temperatures of about 700° C. Further, the blade alloys have been found very difficult to forge and forging has been found desirable in the fabrication of blades from disk alloys. Moreover, the crack growth resistance of disk alloys has not been evaluated.

Accordingly, to achieve increased engine efficiency and greater performance, constant demands are made for improvements in the strength and temperature capability of disk alloys as a special group of alloys for use in aircraft engines. Now these capabilities must be coupled with low fatigue crack propagation rates and a low order of time-dependency of such rates.

What was sought in undertaking the work which lead to the present invention was the development of a processing for a disk alloy which resulted in a low or minimum time dependence of fatigue crack propagation and moreover a high resistance to fatigue cracking.

BRIEF DESCRIPTION OF THE INVENTION

It is accordingly one object of the present invention to provide nickel-base superalloy products which are more resistant to cracking.

Another object is to provide a method for reducing the tendency of nickel-base superalloys to undergo cracking.

Another object is to provide articles for use under cyclic high stress which are more resistant to fatigue crack propagation.

Another object is to provide a method for reducing the time dependency of fatigue cracking in alloys having lower volume concentration of strengthening solids.

Another object of the present invention to provide a method which permits conventional superalloys to be processed in a manner which reduces their inherent tendency toward high fatigue crack propagation.

Another object is to provide a method which employs simple means to alter a nickel base superalloy to one having lower tendency toward fatigue crack propagation.

Another object is to provide a method which is particularly suited for alloys having $\gamma'$ or $\gamma''$ precipitate strengtheners to be processed into a condition in which fatigue crack propagation is lessened.

Another object is to provide a method for treating precipitate-bearing alloys of lower precipitate content to improve the combinations of properties and particularly those relating to fatigue crack propagation.

Other objects will be in part apparent and in part pointed out in the description which follows.

In one of its broader aspects, objects of the present invention can be achieved by selecting an alloy sample having a concentration of hardening precipitate of less than 35 percent by volume. The alloy sample may then be given a preliminary shape by conventional forging or other mechanical forming process.

The sample is then given a solution heat treatment at a temperature above the recrystallization temperature. The sample may be aged following the solution heat treatment.

The sample must have acquired a recrystallized equiaxed grain structure from the heat treatment and should have a strength which is essentially normal for the alloy. The grain size should preferably be of the order of 35 micron average diameter or larger.

The alloy sample is then subjected to mechanical working to distort the grains thereof.

The mechanical working can be by a cold working as by a forging or by a rolling or by a combination of cold working steps.

Alternatively, one or more steps of the working may be accompanied by a heating at a temperature below the recrystallization temperature. The heating is preferably of a type and to an extent which facilitates and enhances the deformation of the grains of the alloy sample.

Any heating which results in a recrystallization or refinement of the grain structure, should be avoided and, if it cannot be avoided entirely, then it should be minimized.

However, the sample may be given an aging heat treatment which does not result in recrystallization and which does not cancel the deformation of the grains.

BRIEF DESCRIPTION OF THE DRAWINGS

In the description which follows clarity of understanding will be gained by reference to the accompanying drawings in which.

DETAILED DESCRIPTION OF THE INVENTION

It has now been discovered that it is possible to impart to nickel base superalloys having relatively lower content of precipitate desirable sets of properties including low fatigue crack propagation rates by thermomechanical processing of the alloys. By lower concentrations of precipitate is meant concentrations less than 35 volume %.

In a description which follows a method is outlined by which the beneficial effects of mechanical deformation on time dependent fatigue crack propagation and the necessary conditions to achieve crack growth resistance are set forth. The method is illustrated principally by the studies of a nickel base superalloy well known in the metals industry and specifically Inconel-718. However, it will be understood that the same principles apply and the same method can be employed to almost all high temperature alloys including essentially all nickel base superalloys having a lower volume % concentration of precipitate to the extent that an alloy which is mechanically workable in the first place may be benefited from the practice of the present invention.

It is known that the nickel base superalloys having a high precipitate content of 40 volume % and greater have quite limited workability and it is because of this limited workability that the subject application does not apply and is not usable effectively in relation to the superalloys having the higher level of precipitate as measured in volume %.

EXAMPLE 1

Several IN-718 heats were prepared by conventional vacuum induction melting. The melts were solidified and the ingots so formed were homogenized by heating at 1200° C. for 24 hours. The ingots were forged into plates according to conventional practice for nickel base wrought superalloys. The chemical composition of the specific IN-718 alloy employed in these examples is set forth in Table I below:

TABLE I

Chemical Composition of Inconel 718

| Element | wt. % |
|---|---|
| Ni | bal. |
| Cr | 19.0 |
| Fe | 18.0 |
| Mo | 3.0 |
| Nb | 5.1 |
| Ti | 0.9 |
| Al | 0.5 |
| C | 0.04 |
| B | 0.005 |

A metallographic study of the samples indicated that the IN-718 alloy starts to recrystallize when subjected to a temperature higher than 950° C.

The forged plates were subjected to standard heat treatment including a solutioning at 975° C. for one hour and a double aging at 720° C. for eight hours. After the eight hour aging the sample were furnace cooled to 620° C. for an additional ten hours aging. The material of the resulting forged plates was found to have a recrystallized equiaxed grain structure. The strength of the forged samples was measured from room temperature up to 700° C. and were found to be similar in strength to that of standard reference material.

Figure 1:
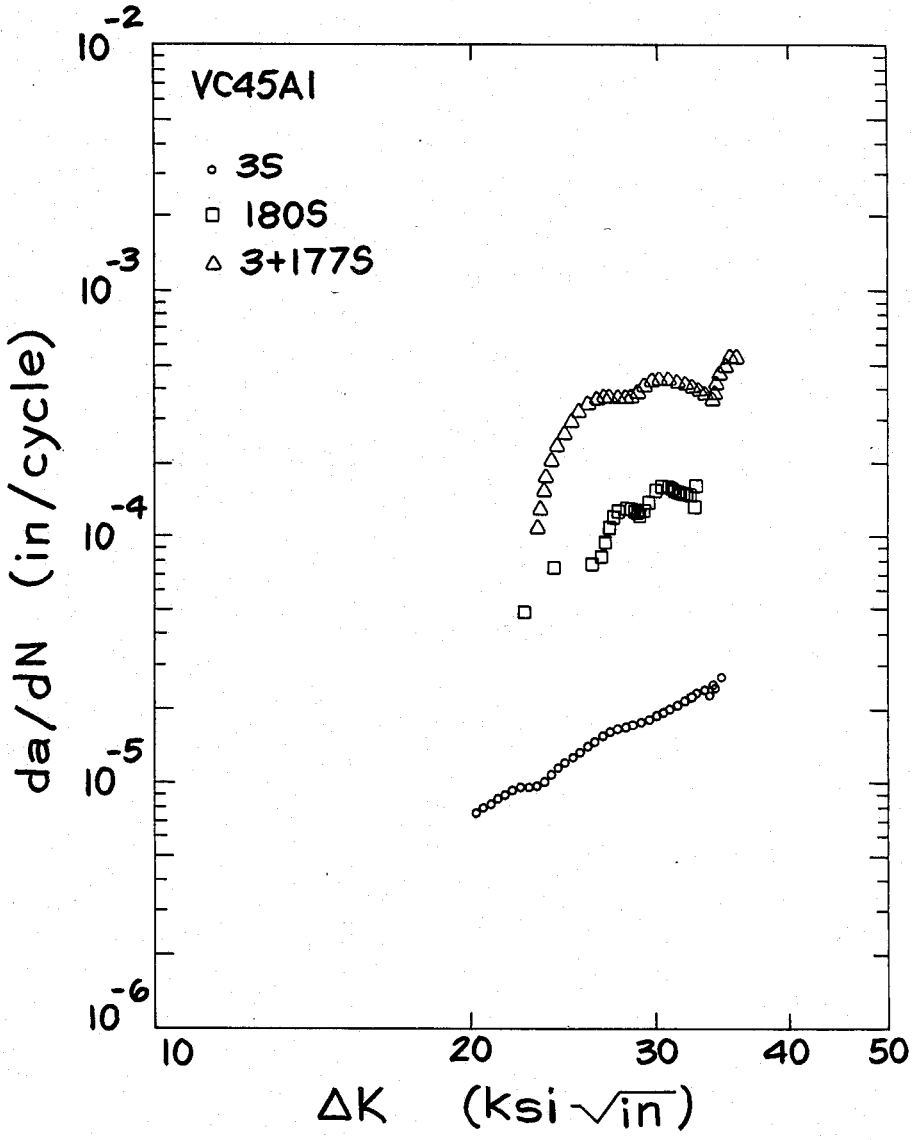
FIGS. 1-6 are graphic (log-log plot) representations of fatigue crack growth rates (da/dN) obtained at various stress intensities ($\Delta K$) for different alloy compositions at elevated temperatures under cyclic stress applications at a series of frequencies one of which cyclic stress applications includes a hold time at maximum stress intensity.
Figure 2:
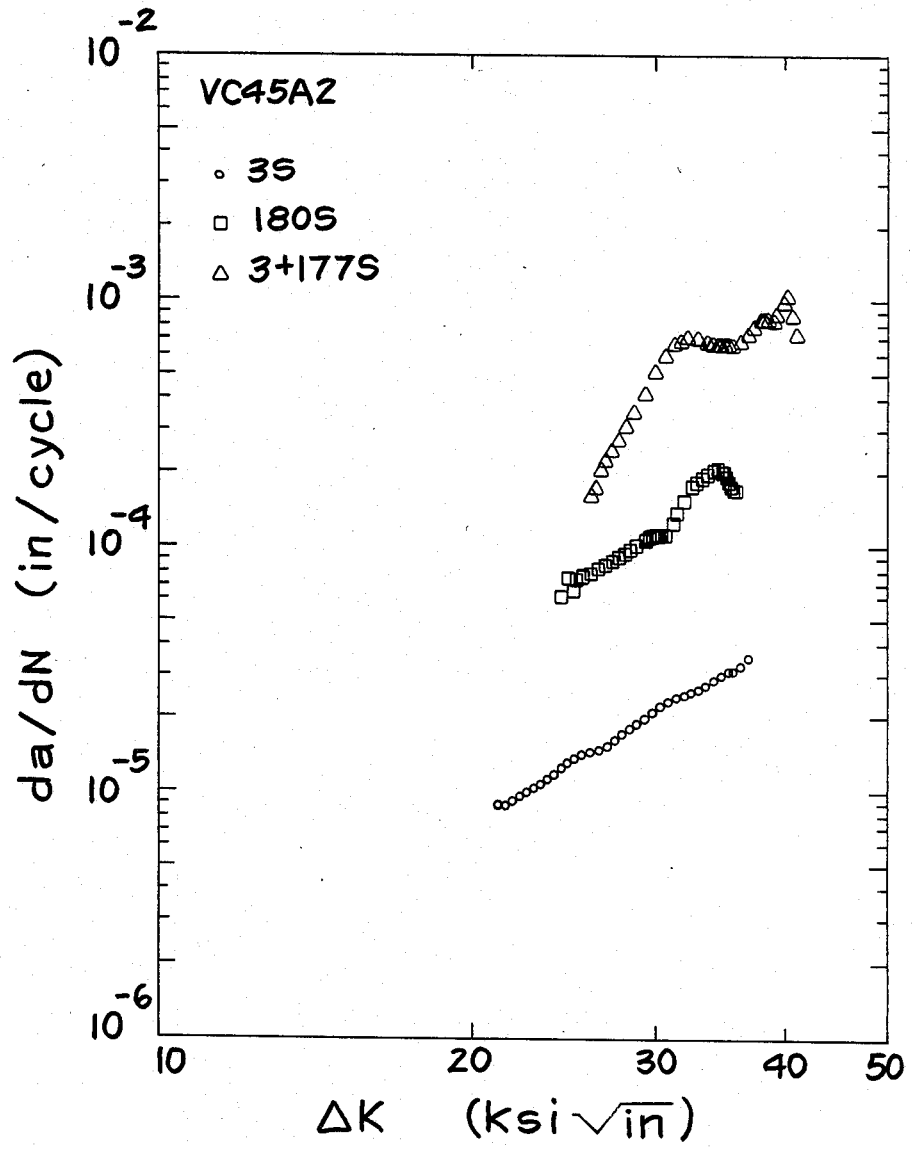

Time dependent fatigue crack propagation was evaluated at 593° C. using three different fatigue waveforms similar to those used in the NASA study. The first was a three second sinusoidal waveform and the second was a 180 second sinusoidal waveform. The third was a 177 second hold at the maximum load of a three second sinusoidal cycle. The maximum to minimum load ratio was set at R=0.05 so that the maximum was 20 X twenty fold higher than the minimum load applied. Data was taken from the studies of the time dependent fatigue crack propagation and the data is plotted in FIGS. 1 and 2. The tests the results of which are illustrated in FIGS. 1 and 2 are essentially duplicate tests. The results demonstrate and it can be observed from the plots that the crack growth rate da/dN increases by a factor of six to eight times when the fatigue cycle is changed from 3 seconds to 180 seconds. The hold time cycle accelerates the crack growth rate by a factor of 20.

EXAMPLES 2 and 3

Two plates prepared as described in Example 1 by vacuum induction melting, homogenization and forging according to conventional practice for wrought superalloys were heated respectively to 1075° C. for Example 2 and 1025° C. for Example 3. Each set of plates was then rolled through a 50% reduction in thickness by four passes through the rolling mill without any reheating. The original dimensions were 3.5 inches by 1.5 inches by 1.5 inches and according the plate mass was so small that substantial temperature drop occurred during the four rolling passes.

A metallographic study was done for each sample and it was determined that elongated grain structure was present. This elongated grain structure indicated that the rolling finished temperature was much lower than the recrystallization temperature of 950° C. It was particularly observed from metallographic study that the deformed grain structure does not contain essentially any fine recrystallized grains along the grain boundaries.

The plates rolled through four passes were subjected to a double aging directly without solutioning. It was found that the materials showed an improved strength over that of solutioned and rolled plates. It was thought that this might possibly be due to a significant amount of residual strains which were introduced below the recrystallization temperature. The high temperature tensile properties of the materials of Examples 2 and 3 are listed in Table II:

TABLE II

Tensile Properties of Inconnel 718 after Various Processings

| | Temp. (°C.) | Yield Strength (ksi) | Tensile Strength (ksi) | Elongation (%) |
|---|---|---|---|---|
| | Solutioning at 975° C./hr | | | |
| Example 1 | 25 | 144.6 | 168.4 | 21.0 |
| | 593 | 139.2 | 163.3 | 17.9 |
| | 649 | 141.8 | 160.8 | 33.8 |
| | 704 | 127.8 | 139.5 | 40.3 |
| | Rolled from 1075° C. | | | |
| Example 2 | 649 | 169.5 | 177.3 | 9.8 |
| | 704 | 170.1 | 179.5 | 22.5 |
| | Rolled from 1025° C. | | | |
| Example 3 | 649 | 176.6 | 187.3 | 13.3 |
| | 704 | 169.6 | 177.6 | 22.8 |
| | Cold Roll 20% | | | |
| Example 4 | 649 | 187.7 | 195.9 | 10.8 |
| | 704 | 169.4 | 177.6 | 18.4 |
| | Cold Roll 40% | | | |
| Example 5 | 649 | 193.7 | 201.9 | 10.8 |
| | 704 | 187.2 | 194.9 | 25.0 |

Fatigue crack growth rate measurements were made and data was gathered similar to that described with reference to Example 1. Tests were conducted and results were obtained for the samples of Example 2 and 3 and the data is plotted respectively in FIGS. 3 and 4. That is, in FIG. 3 the data obtained for Example 2 is plotted and in FIG. 4 the data obtained for Example 3 is plotted. If a comparison is made between the data plotted in FIGS. 3 and 4 with that plotted in FIGS. 1 and 2 it will be observed that the cycle dependent crack growth propagation rate, da/dN, at the three second sinusoidal cycle does not change much. By contrast, however, the time dependent fatigue crack propagation at the 180 second sinusoidal cycle and at the three second sinusoidal cycle with the 177 second hold at maximum load has been improved significantly by the procedure described above which results in a retention of residual strains without solutioning.

Figure 3:
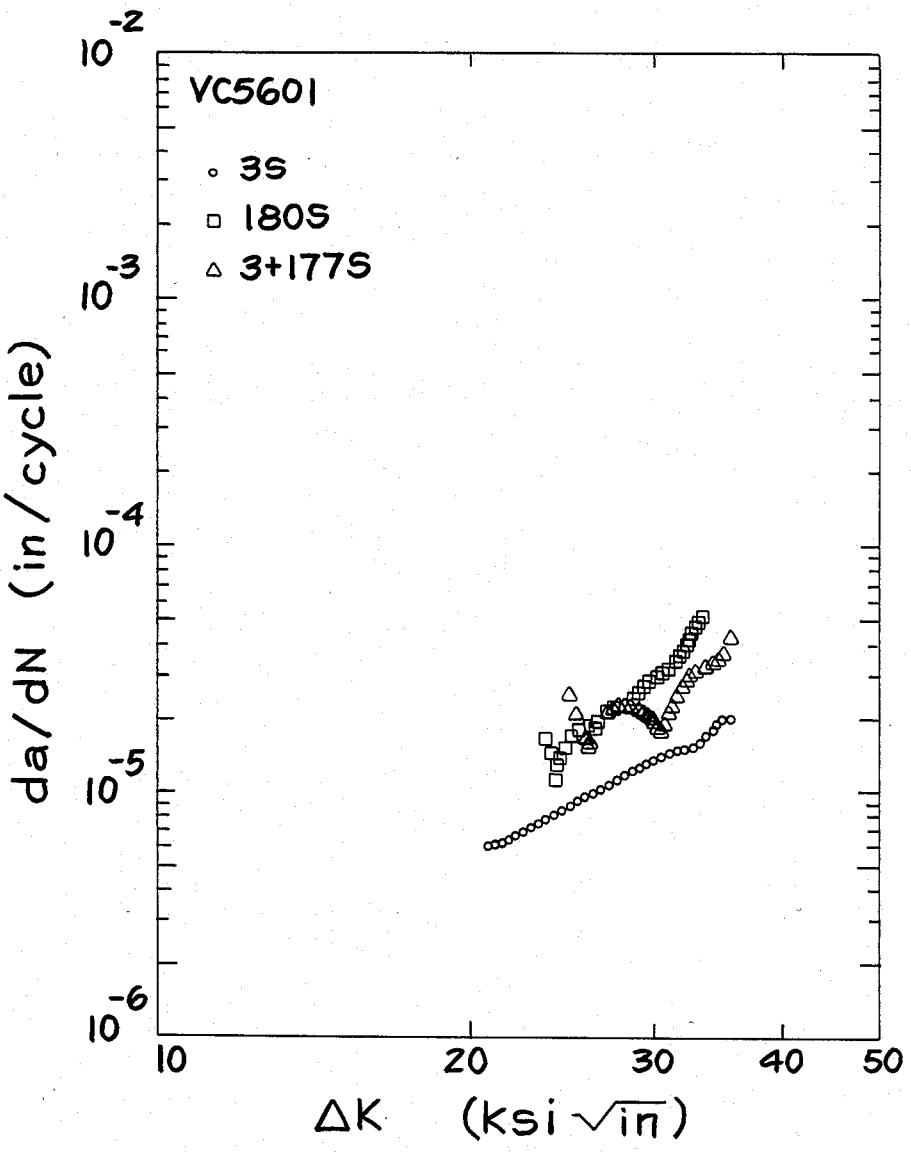
Figure 4:
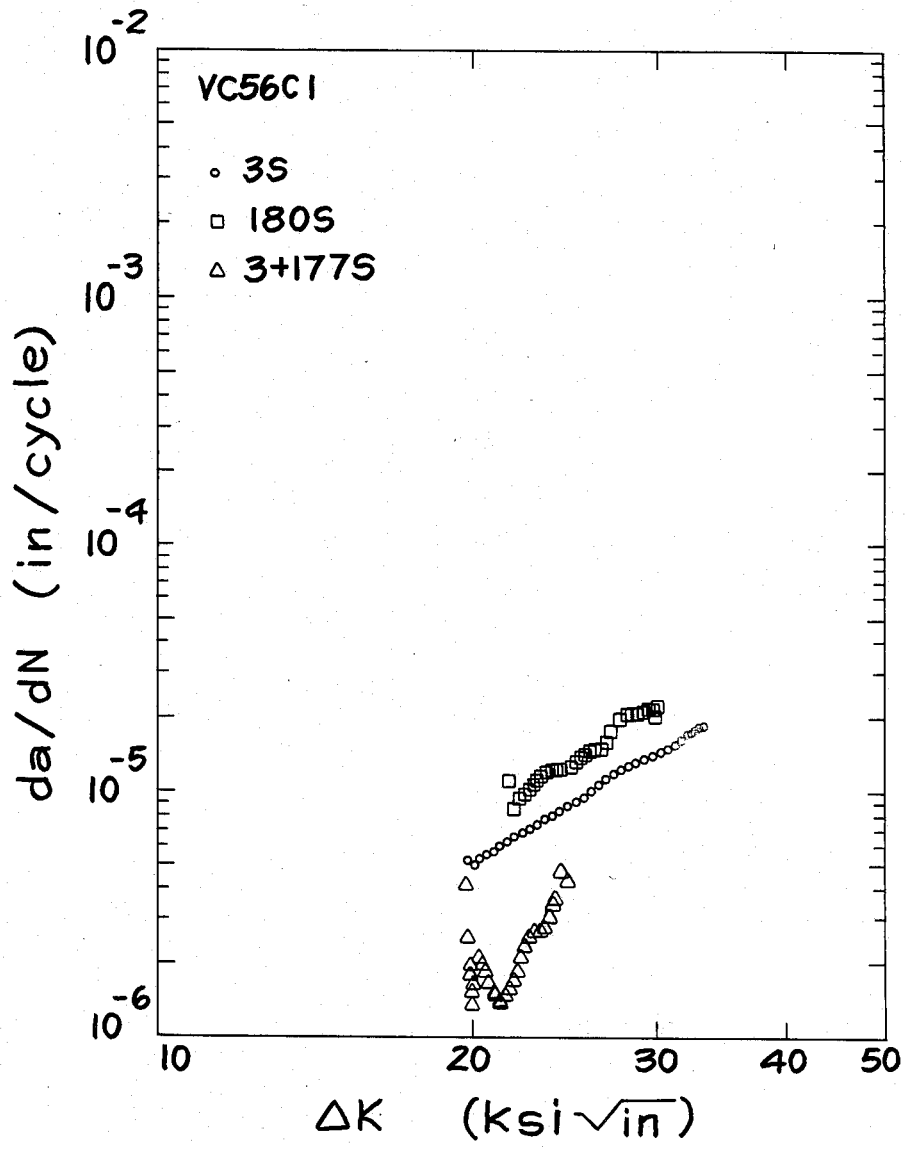

Further from comparison of the data plotted in FIGS. 1 and 2 with that of FIGS. 3 and 4 it is evident that the time dependence of the fatigue crack propagation rate, da/dN, has been effectively suppressed. In the plate rolled from 1025° C. of Example 3 the fatigue crack propagation rate, da/dN, of the hold time cycle, that is the three second sinusoidal cycle with a 177 second hold, was found to be even less than that for the three second sinusoidal cycle.

The mechanism for the improvement in results which are achieved through the present method is not fully understood. However, the mechanism for the improvement of the time dependent fatigue crack propagation is believed to be associated with a retention of mechanical deformation under certain favorable conditions. The favorable conditions are in the absence of a recrystallization heating or other condition which would nullify the effect of the mechanical deformation.

EXAMPLES 4 and 5

Figure 5:
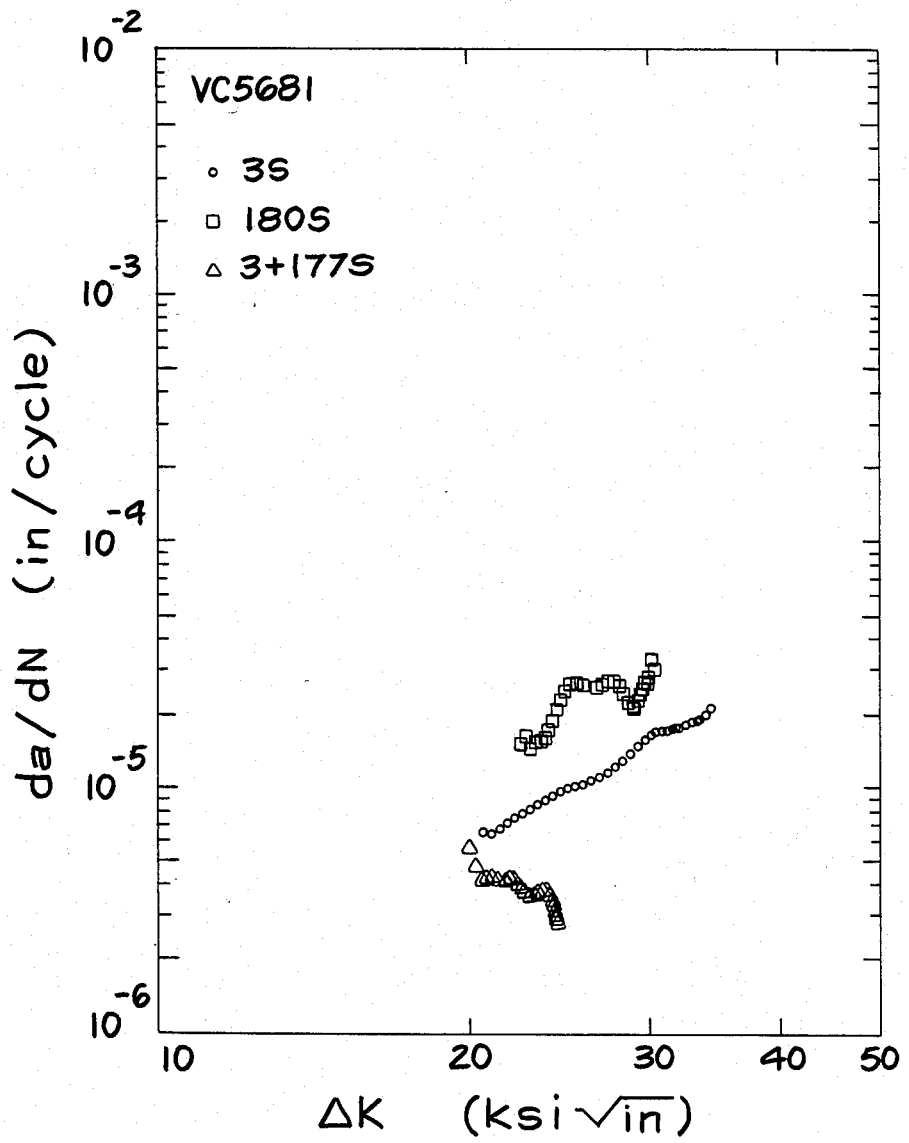
Figure 6:
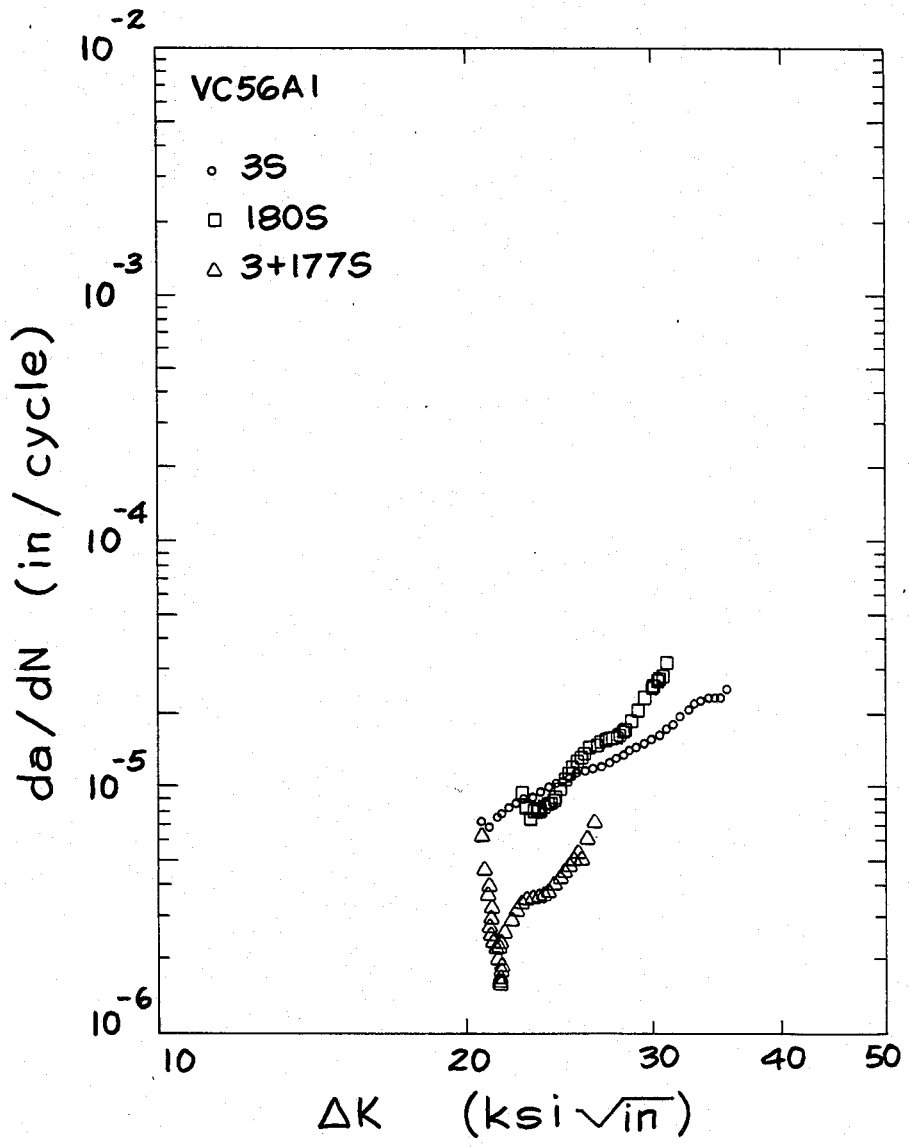

To further demonstrate the effect of reduction of time dependent fatigue crack propagation alloy plates as prepared in Example 1, and specifically alloy plates as prepared by vacuum induction melting followed by homogenization and forging of the plates by conventional wrought superalloy practice, were first prepared. For Example 4 the alloy plate was cold rolled 20%. Test data was taken of fatigue crack propagation rates for this alloy and the results are plotted in FIG. 5. For Example 5 an alloy plate prepared as described above was cold rolled through a 40% reduction in thickness. Fatigue crack propagation rate data was taken for this sample and the data is plotted in FIG. 6. It will be observed from examination and consideration of FIGS. 5 and 6 that the results obtained are similar to those obtained with reference to FIGS. 3 and 4 and that there is significant improvement in the fatigue crack propagation time dependence. In other word the samples are found to be more independent of time relationships of the testing at the three different cycles and particularly at 3 second cycle versus the 180 second cycle versus the 3 second cycle with the 177 hold period at maximum load.

The substance of the description given above is found also in a report entitled "Improving Crack Growth Resistance in IN-718 Alloy Through Thermomechanical Processing" by K-M. Chang, Metallurgy Laboratory, Corporate Research and Development, General Electric Company, Schenectady, N.Y. and identified as report No. 85CRD187 dated October 1985 which report is included with the prior art statement furnished with this application and the text of which report is incorporated herein by reference.

In view of the foregoing, some criteria can be provided for one skilled in the art seeking to practice the subject invention. A main object, as will be evident from the text which precedes, is that the desirable criteria for the starting point for the practice of the present invention is that the subject alloy and specimen to which the process is to be applied should have relatively large grains at the start of the process. For example, for most alloys, a preferred starting grain size would be of the order of 35 micron average diameter or larger.

The main object of the processing steps which follow is to accomplish a deformation of the relatively large grains of the specimen to which the method is to be applied. Such deformation can be accomplished by cold working so that essentially all of the individual grains are subjected to a deformation force and to a deformation.

Where the sample, the grains of which are to be deformed, is heated, the heating should be to a point and to an extent which permits and facilitates the deformation of the grains. The heating should not be of the character which induces grain refinement or grain alteration as a result of the heating. Rather, what is sought is grain deformation and the heating should be of the character, duration and type which facilitates the deformation of the grains of the specimen.

Further, as part of the deformation, it is sought in the practice of the present invention to preserve the effects of the deformation on the grain. For this purpose, any heat treatment or other treatment which would tend to recrystallize and refine the grains is preferably avoided so that the deformed grains can retain the benefit of the deformation which has been imparted thereto in the initial step in the practice of the present invention.

The foregoing is not intended to exclude a heat treatment of the aging variety and aging should definitely be practiced by holding the article at a relatively lower heat temperature for a time to improve the properties and particularly the strength of the alloy. What should be avoided and should not be confused with the aging heating treatment is a heating which will induce recrystallization and, accordingly, cancel or nullify the beneficial effects of the deformation which has been given to the grains of the specimen as part of the practice of the invention as described above.

Again, in setting out the criteria for the practice of the invention it is recognized that various degrees of deformation may be imparted to the specimens. To be an effective deformation for the purposes of carrying out the present invention, a minimum deformation of the order of 15% is specified.

What is claimed and sought to be protected by Letters Patent of the United States is as follows:

1. A method of reducing the fatigue crack propagation rate of a nickel base superalloy which comprises
   selecting a nickel base superalloy having a gamma strengthening precipitate at a volume concentration of less than 35%,
   heating the alloy to recrystallize the grains thereof and to render them of a minimum average diameter of about 35 microns, and
   deforming the grains of the alloy by working the alloy mechanically to change its shape by at least 15%.

2. The method of claim 1 in which the deformation is followed by an aging heat treatment to improve the strength of the alloy.

3. The method of claim 1 in which the working of the alloy is at a temperature below the recrystallization temperature.

4. The method of claim 1 in which the alloy is mechanically worked to a near net shape before the recrystallization heat treatment.

5. The method of claim 1 in which the alloy is worked to a final net shape after recrystallization heat treatment.

6. The method of claim 1 in which the alloy contains a $\gamma'$ or a $\gamma''$ strengthening precipitate or a combination thereof.

7. The method of claim 1 in which the alloy is Inconel-718.

* * * * *